US005887841A

United States Patent [19]

Newberg

[11] Patent Number: 5,887,841

[45] Date of Patent: Mar. 30, 1999

[54] POLE SUPPORT FOR USE IN MAST ASSEMBLY TO ADJUST SAIL TENSION

[76] Inventor: Timothy P. Newberg, 4188 15th St., Boulder, Colo. 80304

[21] Appl. No.: 661,296

[22] Filed: Jun. 13, 1996

[51] Int. Cl.[6] ..... F16M 13/00

[52] U.S. Cl. ..... 248/519; 248/405; 114/90; 114/102; 114/39.1; 114/112

[58] Field of Search ..... 248/405, 519; 114/90, 112, 39.1, 102, 108

[56] References Cited

U.S. PATENT DOCUMENTS

| | | | |
|---|---|---|---|
| 2,176,536 | 10/1939 | McCauley | 248/405 X |
| 2,353,662 | 7/1944 | Goldman . | |
| 2,719,688 | 10/1955 | Seifert . | |
| 2,777,692 | 1/1957 | Marzucco . | |
| 3,092,064 | 6/1963 | Benedict . | |
| 3,507,240 | 4/1970 | Butler . | |
| 3,768,426 | 10/1973 | Kratz . | |
| 3,838,655 | 10/1974 | Kratz . | |
| 3,874,136 | 4/1975 | Michel . | |
| 4,016,823 | 4/1977 | Davis . | |
| 4,353,702 | 10/1982 | Nagy | 114/102 X |
| 4,361,947 | 12/1982 | Arnaud . | |
| 4,530,299 | 7/1985 | Ross . | |
| 4,598,509 | 7/1986 | Woolslayer et al. . | |
| 4,940,008 | 7/1990 | Hoyt . | |
| 4,942,895 | 7/1990 | Lynch . | |
| 5,163,650 | 11/1992 | Adams et al. . | |
| 5,203,746 | 4/1993 | Lehnert . | |
| 5,289,792 | 3/1994 | Forrest et al. . | |
| 5,315,795 | 5/1994 | Chae et al. . | |

FOREIGN PATENT DOCUMENTS

| | | | |
|---|---|---|---|
| 1076347 | 2/1984 | U.S.S.R. | 114/90 |
| 2269148 | 2/1994 | United Kingdom | 114/90 |

*Primary Examiner*—Donald P. Walsh
*Assistant Examiner*—Emmanuel M. Marcelo
*Attorney, Agent, or Firm*—Timothy J. Martin; Michael R. Henson

[57] ABSTRACT

A pole support is adapted for use in a mast assembly of a sail craft to selectively adjust tension of a sail. The mast assembly comprises an elongated and rigid tubular member having a central longitudinal axis and a surrounding sidewall defining an interior therefor. The tubular member has a base portion adapted to engage a mast foot and an upper portion sized to slidably engage a mast pole. A selectively actual drive mechanism includes a lift structure which is operative to support the mast pole and upon actuation of the drive mechanism to adjustably vary the effective length of the mast assembly by moving the mast pole further from and closer to the base portion, thereby to respectively increase and decrease tension of the sail when the tack is secured to the mast foot. The lift structure may also include a collar slidably disposed thereon, which collar has a neck to provide a first protective spacer between the mast pole and the tubular member.

25 Claims, 3 Drawing Sheets

POLE SUPPORT FOR USE IN MAST ASSEMBLY TO ADJUST SAIL TENSION

FIELD OF THE INVENTION

The present invention is broadly directed to adjustable tensioning structures. More particularly, the present invention is directed to sail masts for sailing crafts. The present invention more specifically concerns itself with mechanically driven pole supports for use in mast assemblies of wind propelled sailing crafts, such as sailboards and small sailboats, to selectively adjust the tension on a sail associated therewith.

BACKGROUND OF THE INVENTION

Sailing vessels have long been employed by man as a mode of transportation. Centuries ago sailing vessels, such as a clipper ships, played an instrumental role in man's exploration of new territories and the transportation of goods between these territories. Over the years these sailing vessels have evolved to take on a variety of forms.

Some of these crafts, such as the yacht and the windsurfer or sailboard, are used both recreationally and in competitive sporting events throughout the world. Windsurfing is a recently evolved form of sailing in which a flexible sail that is free to rotate about a mast assembly is mounted onto a surfboard and the craft is guided by a standing rider. Although the craft has a unique design compared to those of larger sailing vessels, the mechanics of operation are quite similar, with the primary goal being to utilize the force of the wind to navigate the craft along a desired course. Navigational versatility is achieved with a triangular sail that can be rotated about the craft's mast assembly to engage the wind at various angles so that the sail serves to propel the craft at any angle to the wind, except head-on.

Modern day windsurfing boards are relatively simple crafts which structurally include a hull with a sail on a tilting mast and a small keel therebeneath. The operator grasps a wishbone boom that is attached to the mast assembly to move the sail in any direction in order to take advantage of the wind. Accordingly, the sail not only drives the windsurfer forward but also steers it.

While the mechanics of operating a windsurfing boards are straightforward and embody the same principals utilized on other sailing vessels, these mechanics are very difficult to master without a great deal of practice. For example, when sailing with the wind directly behind the windsurfer's back, the sail is held at right angles to the wind to propel the craft forward. When sailing into the wind, it is necessary that the sail be held edge-on to the wind so that the wind blows it around. The wind then inflates the sail and curves it so that the sail becomes an air foil. The directional air flow produces a suction force that would pull the sail at right angles to the wind if not for the operator's resistance. Instead, the windsurfer moves forwardly at an angular direction relative to the wind and progresses into the wind in an indirect way by "tacking" or following a zig-zag course. In order to sail crosswise to the wind, the sail is still positioned at right angles to the wind. Here, however, water resistance on the keel of the hull operates to resist movement of the craft in the direction of the wind thereby propelling the craft transversely to the wind's direction.

The sail of a conventional sailboard has its luff edge formed as a sleeve through which a flexible mast pole is slideably received. Typically, the head of the sail is secured to a distal end of the mast post, while the sail's tack is connected at the base of the mast assembly by a tether line.

As such, the sail's luff edge is held in tension between the head and the tack. It is typical to the proper operation of a sailboard that this downhaul tension be maintained in a range of four hundred (400) to six hundred pounds (600 lbs) of force.

It is not uncommon during navigation of a sailboard that the downhaul tension needs to be changed due to changes in wind conditions, for example, wind velocity. In such case, it is necessary to increase or decrease the tension on the tether line which is often under a tension force that is as much as two hundred pounds (200 lbs) acting through a pulley system. This, of course, can be exceedingly difficult for almost anyone, and particularly individuals of less stature. Without some ability to change the effective length of the mast assembly, however, there is sometimes not enough adjustment capability to compensate for such condition. Moreover, this adjustment method causes a change in the center of effort, i.e., the center of force of the wind on the sail relative to the hull. This change causes the torque on the craft to correspondingly change, resulting in alteration of the craft's maneuverability and control.

In the past it has been known to employ a mast assembly having a pole support interposed between the flexible mast pole which receives the sail and the mast foot which is connected to a sailboard in an effort to alleviate this problem. As discussed more thoroughly below in reference to FIGS. 1–3, the pole support of these prior known mast assemblies is telescopically received within the flexible mast pole. The mast pole is supported by a collar which extends around the pole support and this collar is manually positionable at selected discrete locations along the pole support. Accordingly, the effective length of the mast assembly can be changed, and the tension reapplied by the tether and pulley system in order to increase or decrease downhaul tension on the luff edge of the sail.

While this known construction for a mast assembly is advantageous because it provides an alternative approach to adjusting tension on the sail, the manual adjustability of the effective length of the mast assembly can be quite cumbersome. In addition, this type of device has a drawback in that it only permits a limited range of adjustability for the sail's tension. Adjustment is often difficult while the sailcraft is being used since this structure requires removal of the sail tension in order to change the mast assembly length. Accordingly, there remains a need to provide a pole support for use in the mast assembly of a sailing craft which is selectively operable to facilitate adjustability of a sail's tension throughout a broad range of adjustment positions. The present invention is directed to meeting this need, among others.

SUMMARY OF THE INVENTION

It is an object of the present invention to provide a new and useful pole support which is adapted for use in a mast assembly of a sailing craft to selectively adjust tension on a sail associated therewith.

It is another object of the present invention to provide such a pole support for use in a mast assembly that allows for a wide range of tension adjustability without significantly changing the center of effort.

A further object of the present invention is to provide a tension adjusting pole support which may be easily operated by an individual regardless of his/her physical stamina.

Yet another object of the present invention is to provide a pole support that allows a sail's tension to be adjusted while the sailing craft is being used.

A still further object of the present invention is to provide a new and useful mast assembly for use with a sailing craft, which mast assembly is selectively operable to adjust tension on a sail associated therewith.

A still further object of the present invention is to provide a sailing craft, such as a sailboard, which incorporates such a mast assembly.

In accordance with these objectives, then, the present invention broadly provides a pole support that is adapted for use in a mast assembly of a sailing craft that has an effective length and that includes a mast pole to which a head of a sail may be secured and a mast foot which is adapted to mount to the sailing craft and to which a tack of a sail may be secured. The pole support of the present invention is selectively operable to adjust tension of the sail and includes an elongated and relatively rigid tubular member and a selectively actuable drive mechanism associated with this tubular member. The tubular member has a surrounding sidewall defining an interior therefor, a base portion adapted to engage the mast foot and an upper portion sized to slideably engage the mast pole. The drive mechanism is selectively actuable and includes a lift structure which is operative to support the mast pole and upon actuation of the drive mechanism to adjustably vary the effective length of the mast assembly by moving the mast pole further from and closer to the base portion, thereby to respectively increase and decrease tension of the sail when the tack is secured to the mast foot.

Preferably, this tubular member is telescopically received within the mast pole and both the tubular member and the mast pole are generally cylindrical in shape. The sidewall may be formed to include a first longitudinally extending tracking slot therethrough so that a portion of the lift structure is sized and adapted to project from the interior through the first tracking slot to engage the mast pole. A similarly configured second tracking slot may also be formed in the sidewall. This second tracking slot is in a spaced relationship to the first tracking slot and the lift structure is sized and adapted to project partially through both the first and second tracking slots to provide a counterbalancing support for the mast post. The first and second tracking slots are preferably oriented parallel to one another in a diametrically opposed relationship along the tubular member's sidewall.

The drive mechanism includes a threaded shaft extending along the central longitudinal axis of the tubular member, and the lift structure may be formed as a nut which is sized and adapted to threadably engage this shaft in the interior. The portion of the lift structure which projects from the interior through the tracking slots is formed by a pair of radial posts which project outwardly from the nut, whereby rotation of the shaft about the central longitudinal axis causes the nut to travel along the shaft.

A crank handle is provided and operates upon manipulation thereof to actuate the drive mechanism thereby to impart movement to the lift structure. This crank handle is releasably connectable to the drive mechanism. The drive mechanism includes a pair of cooperative bevel gears for transmitting movement of the crank handle into rotational movement of the shaft.

The lift structure may also include a collar slidably disposed around the tubular member supported by the radial posts on the nut. This collar is sized and adapted to support the mast pole so that the lift structure is operative to impart movement to the mast pole during actuation of the drive mechanism. It is preferred that this collar is formed to include a neck projecting upwardly therefrom. This neck has a reduced dimension with respect to the mast pole to provide a first protective spacer between the mast pole and tubular member. A second such protective spacer may be provided by a cap disposed on an upper end of the tubular member. The base portion of the tubular member is releasably connectable to the mast foot. This is accomplished by a plurality of spaced apart mounting holes which extend through the sidewall at the base portion and are sized to releasably engage a cooperative fastening structure associated with the mast foot.

The present invention also provides a mast assembly adapted for use with a sailing craft. This mast assembly has an effective length and is selectively operable to adjust the tension on a sail associated therewith. Broadly, the mast assembly comprises an elongated mast pole, a mast foot, an elongated pole support interposed between the mast pole and the mast foot, and a selectively actuable drive mechanism associated with the pole support. The mast pole is adapted to releaseably connect to the head of the sail and the mast foot is adapted to mount to an upper surface of the sailing craft and to releasably interconnect to the sail's tack. The elongated pole support has a base portion connectable to the mast foot and an upper portion adapted to slidably engage the mast pole whereby the pole support is situated therebetween. The various components of the mast assembly, and particularly the pole support and the drive mechanism associated with the pole support, may be constructed as discussed above.

Finally, the present invention is also directed to a sailing craft that is adapted to propel through water or on ice boats or on wind propelled land craft. Here, the sailing craft comprises a contoured hull member adapted to float on a surface of the water, with this hull member having a lower surface for contacting the water and an opposite upper surface. An upstanding mast assembly, having the same characteristics discussed previously herein, is secured to this upper surface. A sail fabricated from a selected material is releaseably attachable to the mast assembly whereby a head of the sail is connected to the mast pole and a tack of a sail is connected to the mast foot so that the sail is in tension therebetween. A selectively actuable drive mechanism is associated with the pole support and this drive mechanism includes a lift structure which is operative to support the mast pole. Upon actuation of the drive mechanism, this lift structure further operates to vary the effective length of the mast assembly by moving the mast pole further from and closer to the base portion thereby to respectively increase and decrease tension of the sail when the tack is secured to the mast foot.

These and other objects of the present invention will become more readily appreciated and understood from a consideration of the following detailed description of the exemplary embodiment of the present invention when taken together with the accompanying drawings, in which:

DETAILED DESCRIPTION OF THE EXEMPLARY EMBODIMENT

Figure 1:
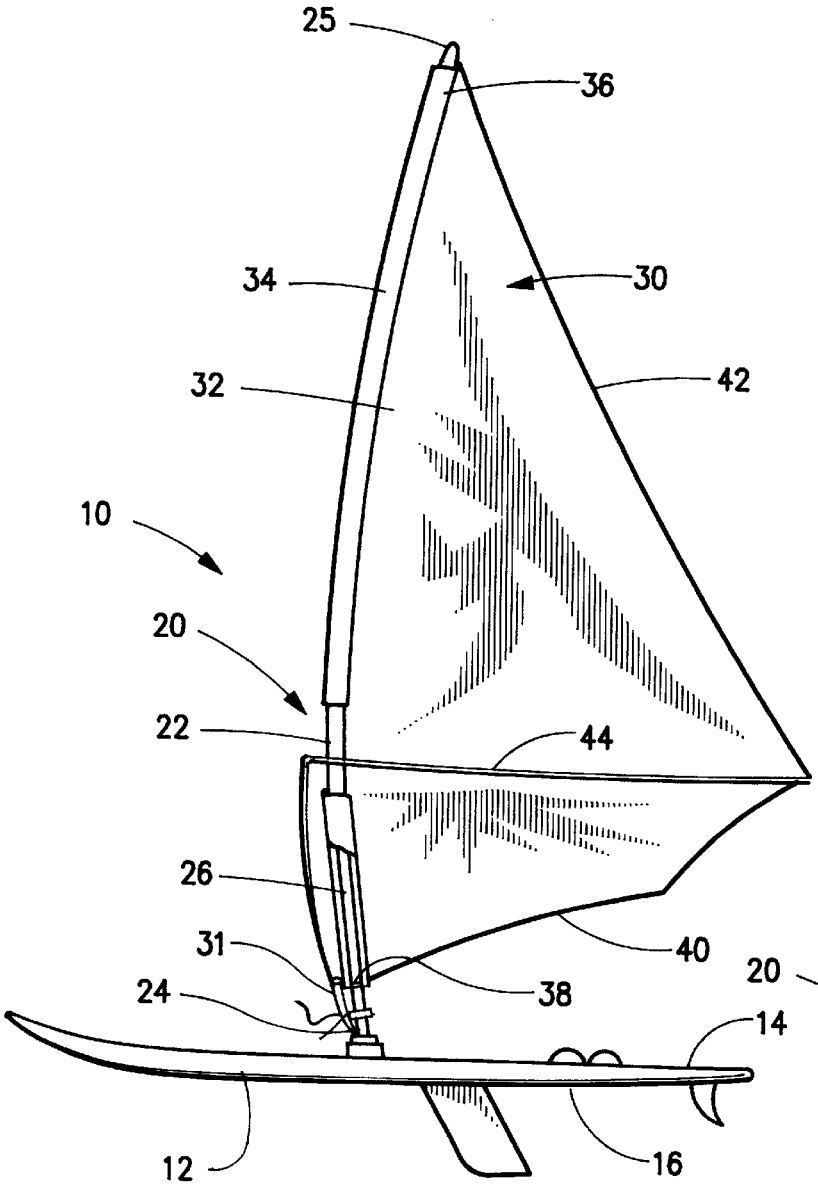
Fig.1 (PRIOR ART)
FIG. 1 is a side view in elevation, partially broken-away, of a prior art mast assembly employed with a conventional sailboard.

The present invention broadly relates to adjustable tensioning devices, but in particular concerns a selectively operable pole support adapted for use in a mast assembly of a sailing craft to adjust tension on a sail associated therewith. It should be understood that this invention could be used with other wind propelled craft as well, including ice boats and land cruisers. The present invention, though, is particularly useful with windsurfing boards, or sailboards. As described above with respect to the background of the present invention, it is known to provide adjustable pole supports in the mast assemblies of conventional windsurfing boards in order to vary the tension on their sails. Thus, as is shown in FIG. 1, a typical sailboard 10 is equipped with a hull 12 having an upper surface 14 and a lower surface 16, and a freely rotatable mast assembly 20 to which a sail 30 is attached. More specifically, the sail's luff edge 32 is formed as a sleeve 34 through which the mast assembly 20 is received. Mast assembly 20 generally includes an elongated and flexible mast pole 22, a mast foot 24 which is secured to upper surface 14, and an adjustable pole support 26 that is interposed between mast pole 22 and mast foot 24.

Sail 30 is a generally triangular mainsail fabricated from a flexible material and has three edges commonly referred to as the foot 40, the leech 42 and luff 32. Sail 30 is secured to mast assembly 20 at two points to prevent dislodgement therefrom during operation. More specifically, the sail's head 36 is secured to a distal end 25 of mast pole 22, while the sail's tack 38 may be secured to either mast foot 24 or pole support 26 by a tether line 31 and pulley system. A tension, therefore, exists along sleeve 34 between these two securement locations. Sail 30 is also interconnected to mast assembly 20 by a wishbone boom 44 so that an operator can manipulate sail 30 during use by rotating the sail 30 about mast assembly 20, thereby to navigate the craft.

Figure 2:
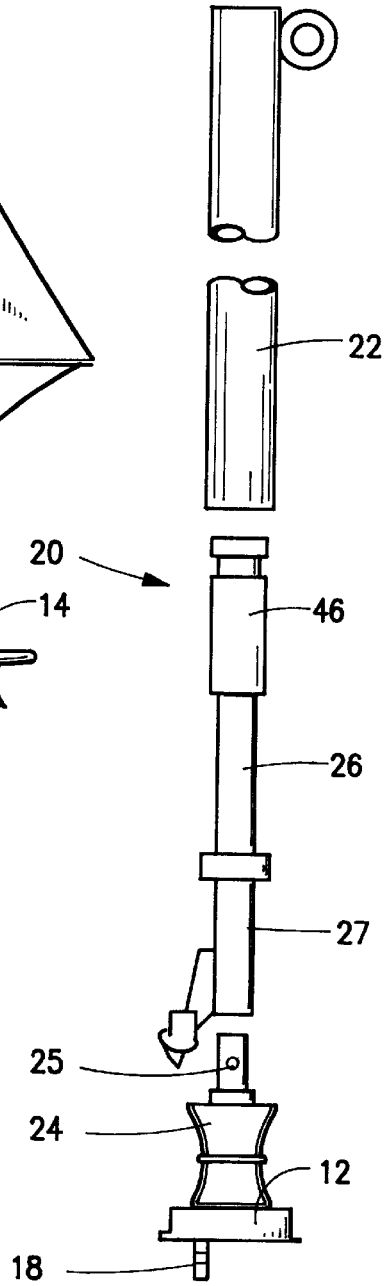
Fig.2 (PRIOR ART)
FIG. 2 is an exploded side view of the mast assembly depicted in FIG. 1.
Figure 3:
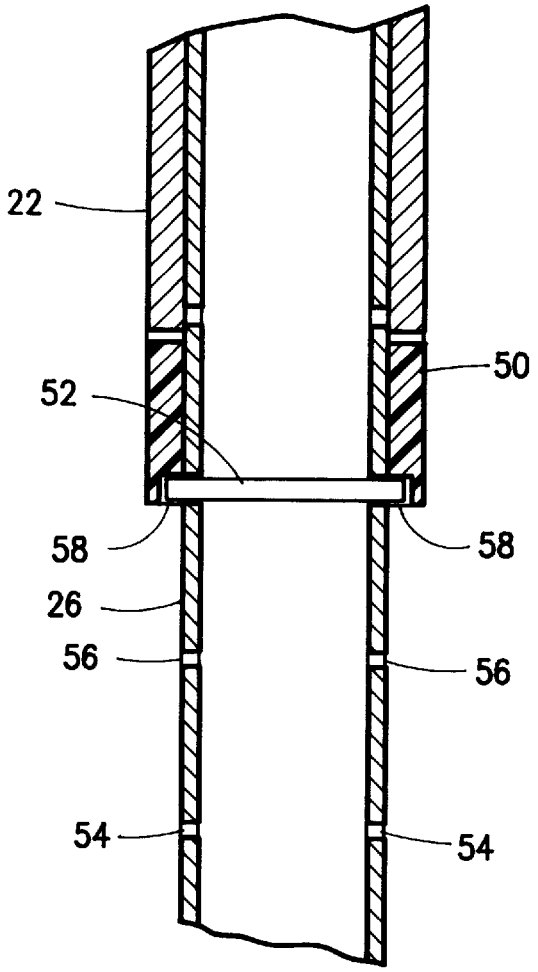
Fig.3 (PRIOR ART)
FIG. 3 is an enlarged side view in cross section showing the adjustability for the mast assembly of FIGS. 1 and 2.

The known construction for mast assembly 20 is best appreciated with reference now to FIGS. 2 and 3 where it may be seen that mast foot 24 is mounted to hull 12 by a threaded bolt 18 which extends therethrough. A base portion 27 of pole support 26 is releasably connectable to and rotatable about an upwardly projecting extension 25 of mast foot 24. Mast pole 22 and pole support 26 are each cylindrical in shape and have different diameters so that pole support 26 is telescopically received within mast pole 22. A sleeve 46 is slidably disposed on pole support 26 to provide a protective spacer between these two members.

As discussed hereinabove in the background of the present invention, it is common during use that the downhaul tension maintained along sleeve 34 needs to be varied. Of course, minor adjustments to the sail's tension can be made by cinching or loosening this tether line 31 but this can be exceedingly difficult as the height between the sail's tack 38 and the mast foot 24 diminishes. This, of course, alters the center of effort and thus affects control and maneuverability.

In order to compensate for this, then, prior art mast assembly 20 incorporates a manual adjustment feature which attempts to both maintain a proper tension within sail 30 and maintain a desired height of sail 30 above hull 12. To accomplish this manual adjustability a plurality of diametrically opposed holes, such as holes 54, 56 and 58, are formed through pole support 26 and a removable pin 52 may be selectively inserted into desired ones of these holes. A collar 50 is provided around pole support 26 and this collar 50 cooperates with pin 52 to support mast pole 22 at a desired position relative to pole support 26. Thus, the effective length of mast assembly 20 is varied and mast pole 22 may be moved upwardly or downwardly along pole support 26, thereby to respectively increase and decrease the tension along sleeve 34 of sail 30.

This known construction for mast assembly 20, though, has several drawbacks. Not only is it difficult to adjust the tension of the sail by moving the mast pole relative to the pole support, but this technique only provides discrete adjustability within a desired tension range. Moreover, if pin 52 is lost or misplaced then there is no recourse and no effective way to reestablish proper tension and sail position along mast assembly 20.

Figure 4:
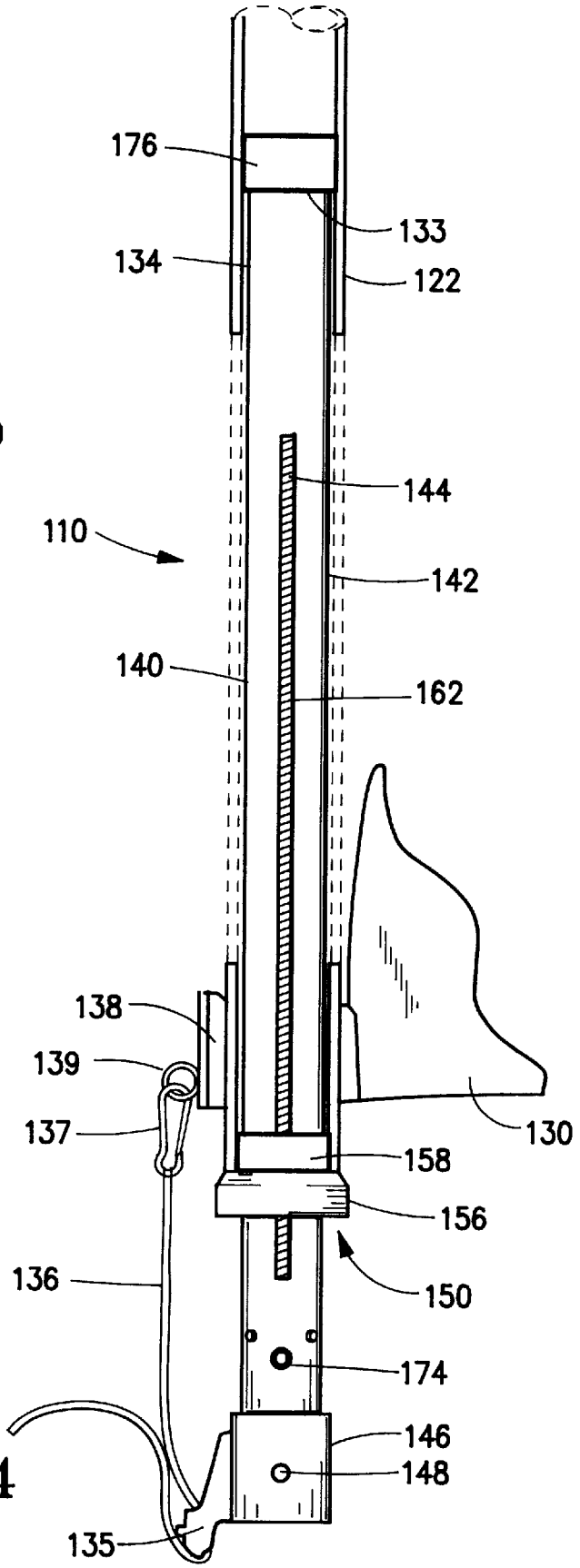
FIG. 4 is a side view in elevation of the mast assembly according to the exemplary embodiment of the present invention, with the mast pole shown partially in phantom.
Figure 5:
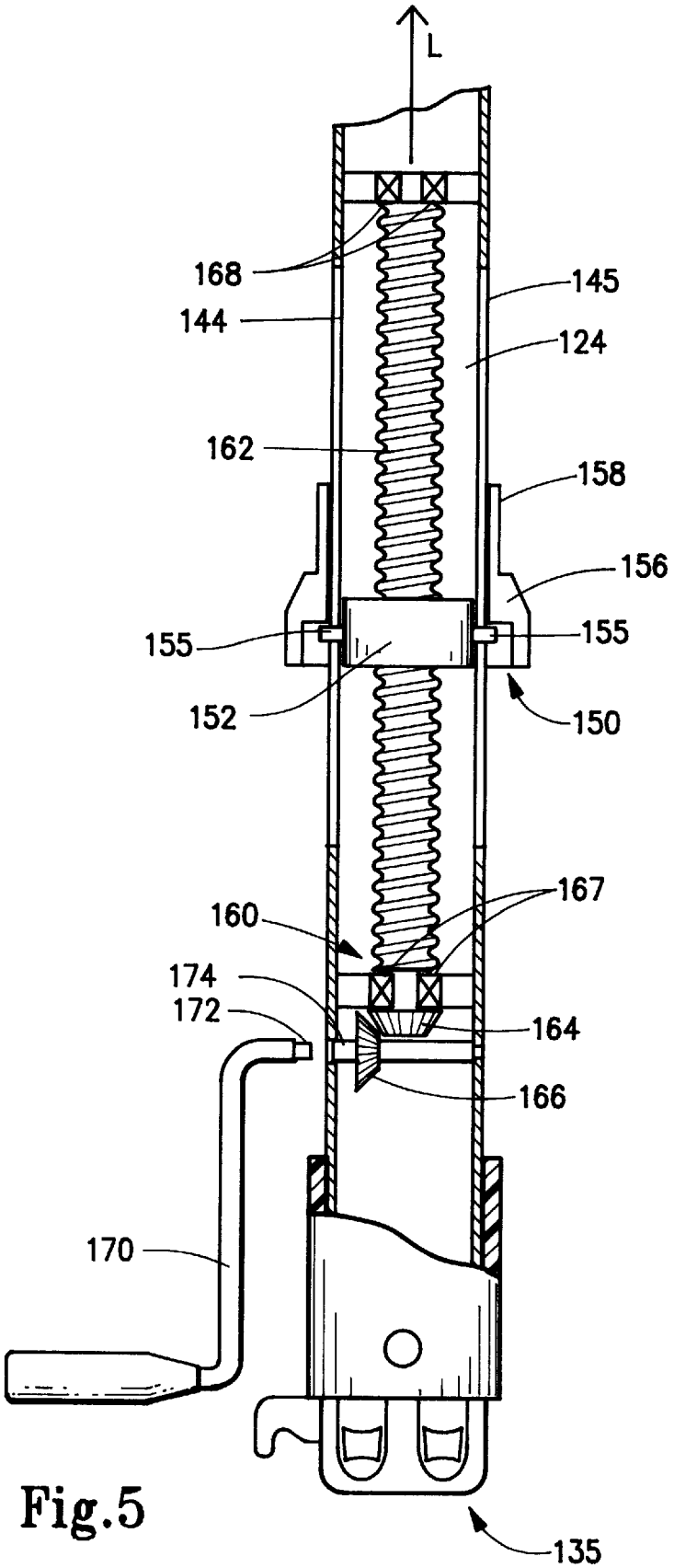
FIG. 5 is a front view in cross-section of the mast assembly in FIG. 3 and specifically showing the drive mechanism associated therewith.

The present invention resolves these deficiencies in the prior art by providing a unique pole support 110 as illustrated in FIGS. 4 and 5. Here, pole support 110 is adapted for use in a mast assembly, as discussed above with reference to prior art FIGS. 1–3, and is selectively operable to adjust tension on a sail 130 associated with a sail craft, such as a sailboard, ice boat, land cruiser, etc. Pole support 110 comprises an elongated and rigid tubular member 140 and a selectively actuable drive mechanism 160 associated with tubular member 140. Tubular member 140 has a central longitudinal axis "L" and a surrounding sidewall 142 defining an interior 124 therefor. A base portion 146 of tubular member 140 is adapted to engage a conventional mast foot. Specifically, sidewall 142 is formed to include a plurality of spaced apart mounting holes 148 extending therethrough at base portion 146 for this purpose. These mounting holes 148 are sized to releasably engage a cooperative fastening structure associated with the conventional mast foot.

As in the prior art, it is preferred that both tubular member 140 and mast pole 122 are generally cylindrical in shape with different diameters such that tubular member 140 is telescopically received within mast pole 122. It is also preferred that sail 130 be positioned at a desired height above base portion 146. Accordingly, the sail's tack 138 is interconnected to a pulley system 135 by a tether line 136. This tether line 136 is threaded through pulley system 135 and interconnected to a mounting ring 139 by clasp 137. Thus, minor adjustments to the tension of sail 130 can be made by either cinching tether line 136 or by placing slack in the line.

While it is discussed herein that the sail's tack 138 may be interconnected to base portion 146 by a tether line 136 and pulley system 135, it should be appreciated by one of ordinary skill in this field that the present invention also contemplates that a fixed length cord may be utilized to interconnect the sail's tack 138 to either base portion 146 of the mast foot. An operator then simply needs to actuate drive mechanism 160 for any variance of the downhaul tension that is desired. Accordingly, the conventional pulley system incorporated in prior mast assemblies to interconnect the sail's tack to either the mast foot or the pole support can be eliminated with the present invention.

Drive mechanism 160 includes a lift structure 150 which is operative to support mast pole 122 and which is further operative upon actuation of drive mechanism 160 to adjustably vary the effective length of the mast assembly by moving mast pole 122 further from and closer to base portion 146, thereby respectively increasing and decreasing tension of sail 130 when tack 138 is secured. A crank handle 170 is provided and operates upon manipulation thereof by a user to actuate drive mechanism 160 thereby to impart movement to lift structure 150. It is preferred that this crank handle 170 is releaseably connectable to drive mechanism 160. Crank handle 170 is therefore provided with a contoured extension 172 which releasably engages an access opening 174 associated with drive mechanism 160.

Sidewall 142 includes first and second longitudinally extending tracking slots 144 and 145, respectively, formed therethrough. These tracking slots 144 and 145 are oriented parallel to one another in a diametrically opposed relationship along sidewall 142. Lift structure 150 is adapted to project from the interior 124 through both of these tracking slots 144 and 145 to engage mast pole 122.

A preferred construction for drive mechanism 160 and lift structure 150 may best be appreciated with reference to FIG. 5 wherein it may be seen that drive mechanism 160 includes an elongated threaded shaft 162 centered about longitudinal axis "L". Threaded shaft 162 operates to rotate about longitudinal axis "L" in response to manipulation of crank handle 170 and a pair of cooperative bevel gears 164, 166 are provided so that rotational movement of crank handle 170 imparts rotational movement to elongated shaft 162. Support bearings 167 and 168 are provided to guide rotation of elongated shaft 162 within interior 124.

Lift structure 150 includes a nut 152 which is sized and adapted to threadedly engage elongated shaft 162 and this nut 152 has radial posts 154 and 155 which extend, respectively, through tracking slots 144 and 145 formed in sidewall 142. Lift structure 150 also includes a collar 156 which rests on these radial posts 154 and 155. Collar 156 is slidably disposed around tubular member 140 and is sized and adapted to support the mast pole 122 so that actuation of drive mechanism 160 via manipulation of crank handle 170 imparts either upward or downward movement to both lift structure 150 and mast pole 122. Collar 156 is preferably formed to include a neck 158 which projects upwardly therefrom. This neck 158 has a reduced dimension with respect to that of mast pole 122 to provide a first protective spacer between mast pole 122 and tubular member 140. As shown in FIG. 4, a cap 176 may also be disposed on an upper end 133 of tubular member 140, and this cap has a dimension equal to that of neck 158 so that a second protective spacer is provided between mast pole 122 and tubular member 140.

With the foregoing description in mind with reference to the exemplary embodiment of the pole support 110 of the present invention, then, it may be appreciated that in operation pole support 110 may be used as a component in a mast assembly of a sailing craft, such as a windsurfing board, to selectively adjust tension on a sail. This device facilitates both initial rigging, due to greater mechanical advantage of the drive mechanism over the pulley system, and adjustment of downhaul tension during use due to the simplified tensioning of the tack. During use, an operator may now easily readjust the sail's downhaul tension by simply manipulating the crank handle. That is, the crank handle is inserted into the pole support of the present invention to actuate the drive mechanism associated therewith. By rotating the crank handle in a clockwise direction, the effective length of the mast assembly is increased because the lift structure operates to slidably move the mast pole further from the base portion of the tubular member, thereby increasing tension of the sail. On the other hand, when the crank handle is rotated in a counterclockwise direction the lift structure progresses downwardly along the tubular member's tracking slots and permits the mast pole to move closer to the base portion, thereby decreasing the effective length of mast assembly and decreasing tension of the sail. In either case, the tack location remains relatively constant with reference to the hull.

The construction for the pole support of the present invention affords advantages over the prior art in that it facilitates adjustment of the tension along the sail's sleeve while the windsurfing board is being used. Moreover, tension can be adjusted with much less effort. The pole support of the present invention also permits adjustability over a wide range of tensions so that the sail can easily be positioned at a desired height along the mast assembly. Of course, while the drive mechanism which comprises part of the pole support of the present invention has been described herein with reference to a gear system, it should be readily appreciated and understood by one of ordinary skill in this field that other drive mechanisms are certainly contemplated. For example, the drive mechanism associated with the tubular member could be a hydraulic drive, or a self-locking rack and pinion drive.

Accordingly, the present invention has been described with some degree of particularity directed to the exemplary embodiment of the present invention. It should be appreciated, though, that the present invention is defined by the following claims construed in light of the prior art so that modifications or changes may be made to the exemplary embodiment of the present invention without departing from the inventive concepts contained herein.

I claim:

1. A pole support adapted for use in a mast assembly of a sail craft that has an effective length and that includes a mast pole to which a head of a sail is adapted to be secured and a mast foot which is adapted to mount to the sailing craft and to which a tack of the sail may be connected, said pole support selectively operable to adjust tension of the sail, comprising:

(a) an elongated and rigid tubular member having a central longitudinal axis and a surrounding sidewall defining an interior therefor, said tubular member having a base portion adapted to engage the mast foot and an upper portion sized to slidably engage the mast pole; and (b) a selectively actuable drive mechanism associated with said tubular member, said drive mechanism including a lift structure which is operative to support the mast pole and upon actuation of said drive mechanism to adjustably vary the effective length of the mast assembly by moving the mast pole further from and closer to the base portion, thereby to respectively increase and decrease tension of the sail when the tack is secured to the mast foot, said lift structure including a collar freely and slidably disposed around said tubular member to allow for manual adjustment of the effective length of the mast assembly, said collar sized and adapted to support the mast pole so that said lift structure is operative to impart movement to the mast pole during actuation of said drive mechanism.

2. A pole support according to claim 1 wherein the tubular member is telescopically received within the mast pole.

3. A pole support according to claim 2 wherein each of said tubular member and the mast pole is generally cylindrical in shape.

4. A pole support according to claim 2 wherein said sidewall is formed to include a first longitudinally extending tracking slot therethrough, a portion of said lift structure sized and adapted to project from the interior through said first tracking slot to engage the mast pole.

5. A pole support according to claim 4 wherein said sidewall is formed to include a second longitudinally extending tracking slot therethrough in a spaced relationship to said first tracking slot and wherein said portion of said lift structure is sized and adapted to project through both said first and second tracking slots to provide a counterbalancing support for the mast post.

6. A pole support according to claim 5 wherein said drive mechanism includes a threaded shaft extending along the central longitudinal axis, said lift structure including a nut which is sized and adapted to threadably engage said shaft in the interior of said tubular member and wherein said portion of said lift structure is formed by a pair of radial posts which project outwardly from said nut through said first and second tracking slots, respectively, whereby rotation of said shaft about the central longitudinal axis imparts movement to said lift structure along said first and second tracking slots, said collar seated on said radial posts.

7. A pole support according to claim 6 including a crank handle adapted to engage said drive mechanism and operative upon manipulation thereof to actuate said drive mechanism by imparting rotational movement to said shaft.

8. A pole support according to claim 7 wherein said drive mechanism includes a pair of cooperative bevel gears for transmitting movement of said crank handle into rotational movement of said shaft.

9. A pole support according to claim 5 wherein said first and second tracking slots are oriented parallel to one another in an opposed relationship along said sidewall.

10. A pole support according to claim 1 wherein said collar is formed to include a neck projecting upwardly therefrom, said neck having a reduced dimension with respect to the mast pole to provide a first protective spacer between the mast pole and said tubular member.

11. A pole support according to claim 10 including a cap disposed on an upper end of said tubular member, said cap having a dimension equal to that of said neck so that a second protective spacer is provided between the mast pole and said tubular member.

12. A pole support according to claim 1 including a crank handle adapted to engage said drive mechanism and operative upon manipulation thereof to actuate said drive mechanism, thereby to impart movement to said lift structure.

13. A pole support according to claim 12 wherein said crank handle is releasably connectable to said drive mechanism.

14. A pole support according to claim 1 wherein said base portion of said tubular member is releasably connectable to the mast foot.

15. A pole support according to claim 14 wherein said sidewall is formed to include a plurality of spaced apart mounting holes extending therethrough at said base portion, said mounting holes sized to releasably engage a cooperative fastening structure associated with the mast foot.

16. A pole support according to claim 1 wherein said drive mechanism is a worm gear drive.

17. A mast assembly having an effective length and adapted for use with a sail craft, said mast assembly selectively operable to adjust tension on a sail associated therewith, comprising:

(a) an elongated mast pole adapted to releasably connect to a head of the sail;

(b) a mast foot adapted to mount to an upper surface of the sailing craft and to releasably interconnect to a tack of the sail;

(c) an elongated pole support having a base portion connectable to said mast foot and an upper portion adapted to slidably engage said mast pole whereby said pole support is situated therebetween, said pole support constructed as a rigid tubular member having a surrounding sidewall defining an interior therefor; and (d) a selectively actuable drive mechanism associated with said pole support, said drive mechanism including a lift structure which is operative to support the mast pole and upon actuation of said drive mechanism to adjustable vary the effective length of said mast assembly by moving the mast pole further from and closer to said base portion, thereby to respectively increase and decrease tension of the sail when the tack is secured to the mast foot, said lift structure including a collar slidably disposed around said tubular member, said collar sized and adapted to support the mast pole so that said lift structure is operative to impart movement to the mast pole during actuation of said drive mechanism, said collar including a neck projecting upwardly therefrom and having a reduced dimension with respect to the mast pole to provide a first protective spacer between the mast pole and said tubular member.

18. A mast assembly according to claim 17 wherein each of said tubular member and the mast pole is cylindrical in shape, said tubular member sized to be slidably received within the mast post.

19. A mast assembly according to claim 18 wherein said sidewall is formed to include first and second longitudinally extending tracking slots therethrough, said lift structure adapted to project from the interior through both of said first and second tracking slots to engage the mast post.

20. A mast assembly according to claim 19 wherein said first and second tracking slots are oriented parallel to one another in an opposed relationship along said sidewall.

21. A mast assembly according to claim 17 including a cap disposed on an upper end of said tubular member, said cap having a dimension equal to that of said neck so that a second protective spacer is provided between the mast pole and said tubular member.

22. A mast assembly according to claim 17 including a rotary crank handle adapted to engage said drive mechanism and operative upon manipulation thereof to actuate said drive mechanism, thereby to impart movement to said lift structure.

23. A mast assembly according to claim 22 wherein said crank handle is releasably connectable to said drive mechanism.

24. A mast assembly according to claim 17 wherein, said base portion of said tubular member is releasably connectable to the mast foot.

25. A sail craft adapted to propel through water, comprising:

(a) a contoured hull member adapted to float on a surface of the water, said hull member having a lower surface for contacting the water and an opposite upper surface;

(b) an upstanding mast assembly having an effective length and secured to said upper surface, said mast assembly including a mast foot mounted to the upper surface, a mast pole, and an elongated pole support having a base portion mountable to said mast foot and an upper portion adapted to slidably engage said mast pole whereby said pole support is situated therebetween, said pole support constructed as a rigid tubular member having a central longitudinal axis and including a surrounding sidewall forming an interior therefor;

(c) a sail fabricated from a selected material and releasably attachable to said mast assembly whereby a head of said sail is connected to said mast pole and a tack of said sail is connected to said mast foot so that said sail is in tension therebetween; and (d) a selectively actuable drive mechanism associated with said pole support, said drive mechanism including a lift structure which is operative to support the mast pole and upon actuation of said drive mechanism to adjustably vary the effective length of said mast assembly by moving the mast pole further from and closer to said base portion thereby to respectively increase and decrease tension of the sail when the tack is secured to the mast foot, said lift structure including a collar slidably disposed around said tubular member, said collar sized and adapted to support the mast pole so that said lift structure is operative to impart movement to the mast pole during actuation of said drive mechanism, said collar including a neck projecting upwardly therefrom and having a reduced dimension with respect to the mast pole to provide a first protective spacer between the mast pole and said tubular member.

* * * * *